United States Patent [19]

Hubbard

[11] 4,207,717

[45] Jun. 17, 1980

[54] SYSTEM FOR IMPROVING HEAT INSULATING CHARACTERISTICS OF EXISTING CURTAIN WALLS AND THE LIKE

[75] Inventor: S. Eugene Hubbard, Niles, Mich.

[73] Assignee: Kawneer Company, Inc., Niles, Mich.

[21] Appl. No.: 952,300

[22] Filed: Oct. 18, 1978

[51] Int. Cl.[2] ..... E04B 2/28; E04C 1/04; E04C 1/07

[52] U.S. Cl. ..... 52/235; 52/770; 52/771; 52/775

[58] Field of Search ..... 52/235, 476, 771, 770, 52/775, 764

[56] References Cited

U.S. PATENT DOCUMENTS

| | | | |
|---|---|---|---|
| 3,016,993 | 1/1962 | Owen | 52/770 X |
| 3,205,630 | 9/1965 | Felix et al. | 52/775 X |
| 3,334,463 | 8/1967 | Muessel | 52/775 |
| 3,403,491 | 10/1968 | Eichman | 52/775 X |
| 3,423,897 | 1/1969 | Birum, Jr. | 52/773 |
| 3,720,025 | 3/1973 | Eichman | 52/235 X |
| 3,769,775 | 11/1973 | Brzezinski | 52/775 X |
| 3,774,360 | 11/1973 | Hubbard et al. | 52/127 |
| 3,961,452 | 6/1976 | Hubbard et al. | 52/775 X |

*Primary Examiner*—Stephen J. Novosad

*Attorney, Agent, or Firm*—Mason, Kolehmainen, Rathburn & Wyss

[57] ABSTRACT

A system for improving the heat insulating characteristics of existing wall structures, which wall structures include panels and panel edge supporting frames with pockets in a jamb face thereof receiving an edge of the panels. The system includes an elongated stop element having a base adapted to be secured to the jamb face and extended into the pocket after the existing panel has been removed therefrom. The stop element includes a flange extending outwardly of the jamb face to form a supportive side wall of a new glazing pocket adapted to receive an edge portion of a new insulating type panel. An elongated flange element is adapted to be secured on the existing frame in spaced alignment with the flange of the new stop element to form an opposite side wall for the new glazing pocket for securing the new insulating panel in place.

40 Claims, 6 Drawing Figures

SYSTEM FOR IMPROVING HEAT INSULATING CHARACTERISTICS OF EXISTING CURTAIN WALLS AND THE LIKE

BACKGROUND OF THE INVENTION

1. Field of the Invention

The present invention relates to curtain wall systems and more particularly relates to a system for improving the heat insulating characteristics of existing curtain wall structures by the conversion and replacement of existing panels having relatively poor heat insulating characteristics with new insulating panels having better heat insulating qualities. Many buildings have been constructed in the past few decades employing curtain wall systems having large glass areas, usually of the single thickness type and supported in a frame work formed of members of extruded aluminum or metal. In the past, the energy cost for heating these types of buildings was relatively low and accordingly, little concern was directed toward the improvement of the heat insulating characteristics of such buildings.

With the recent energy crunch however, resulting in greatly elevated energy costs, improvement of the heat insulating characteristics of existing buildings has become an important factor. In addition to relatively poor thermal characteristics, of many existing buildings, particularly in colder climates, there have been other problems such as the formation of condensation and frost on the interior surfaces of the glass panels and their supporting frame members. Removal of this condensation moisture and the ice or frost creates considerable inconvenience to the occupants and owners of the buildings and sometimes results in physical damage. The aforementioned difficulties and problems do not appear to have been effectively or efficiently corrected with presently available systems on an economically sound basis.

2. Description of the Prior Art

One system for improving the heat insulating characteristics of curtain walls and the like, but without requiring the removal of existing glazing panels is shown and described in U.S. Pat. No. 4,120,127, which patent is assigned to the same assignee as the present application. The references cited against the foregoing patent also disclose several different types of systems for improving the heat insulating characteristics of curtain walls, windows and the like. In actual practice some of these systems have encountered the problems of air leakage through sealing faults and moisture condensation often develops in the space between an existing glazing panel and an additional insulating panel that is added in spaced relation thereto.

Another problem that occurs in systems of this type is that of insuring that an additional glazing panel and the original or existing glazing panel are clean and spotless before a more or less permanent interrelationship between the spaced panels is established. If cleanliness is not achieved, smudges, marks, streaks and the like will then become a more or less permanent part of the completed curtain wall structure which then has an unsightly appearance.

OBJECTS OF THE INVENTION

It is an object of the present invention to provide a new and improved system for the conversion of existing wall structures into better insulated wall structures.

Another object of the present invention is to provide a new and improved conversion system of the character described which greatly improves the heat insulating characteristics of the paneled portion of a wall structure.

Another object of the present invention is to provide a new and improved system of the character described which greatly improves the heat insulating characteristics of the supporting structural framework of the wall structure.

Another object of the present invention is to provide a new and improved system of the character described which greatly facilitates replacement of existing single thickness glazing panels with heat insulating panels having much lower heat loss characteristics.

Yet another object of the present invention is to provide a new and improved system of the character described which facilitates a rapid and efficient conversion from an existing wall structure having high thermal losses to a greatly improved insulating wall structure having much lower thermal losses with a minimum inconvenience to the occupants of the building during the conversion process.

Yet another object of the invention is to provide a new and improved system of the character described which greatly improves the heat insulating characteristics of both the panels and the structural elements supporting the panels in a wall system.

Yet another object of the present invention is to provide a new and improved system for thermally upgrading building curtain walls and the like.

More particularly, it is an object of the present invention to provide a new and improved system for thermally upgrading a curtain wall system of the type having relatively large areas of single thickness glazing panels secured in frame work of extruded metal or aluminum frame members.

Still another object of the invention is to provide a new and improved system of the character described which employs a unitary, double or triple pane, factory manufactured, insulating type glazing panels for replacing existing single thickness panels.

Another object of the present invention is to provide a new and improved system of the character described which eliminates many or all of the difficulties encountered in many previous attempts at thermally upgrading existing single glazed wall structures.

Yet another object of the invention is to provide a new and improved system of the character described which provides a finished, insulating type curtain wall structure which is neat in appearance, thermally efficient and relatively low in cost in comparison to other types of curtain wall systems of equal thermal effectiveness.

SUMMARY OF THE INVENTION

The foregoing and other objects and advantages of the present invention are accomplished in a new and improved system for the conversion of existing curtain wall structures into insulated panel wall structures having improved thermal characteristics. The system includes an elongated stop element having a base which is adapted to be secured to a jamb face of a supporting frame member in an existing wall system after a single thickness glazing panel has been removed. The elongated stop element includes a key portion, key fitted to extend into a pocket in the jamb, which pocket previously accommodated the removed single thickness glazing panel. The stop element includes a flange extending outwardly of the jamb face forming an inside wall of a new, enlarged glazing pocket which is adapted to receive an edge portion of a replacement insulating glazing panel, usually having dual or triple panes and having a greater thickness and improved heat insulating characteristics in comparison to the existing panel that was removed. An elongated flange element is adapted to be secured on the existing frame in spaced alignment with the flange of the stop element to form an opposite side wall of the new glazing pocket for securing the new insulating panel in place in the existing frame work. The system may also include an outer cover element mounted in spaced apart relation on the existing frame member in heat insulated relation with respect thereto and the cover further reduces heat losses of the curtain wall system.

DESCRIPTION OF THE PREFERRED EMBODIMENTS

Figure 1:
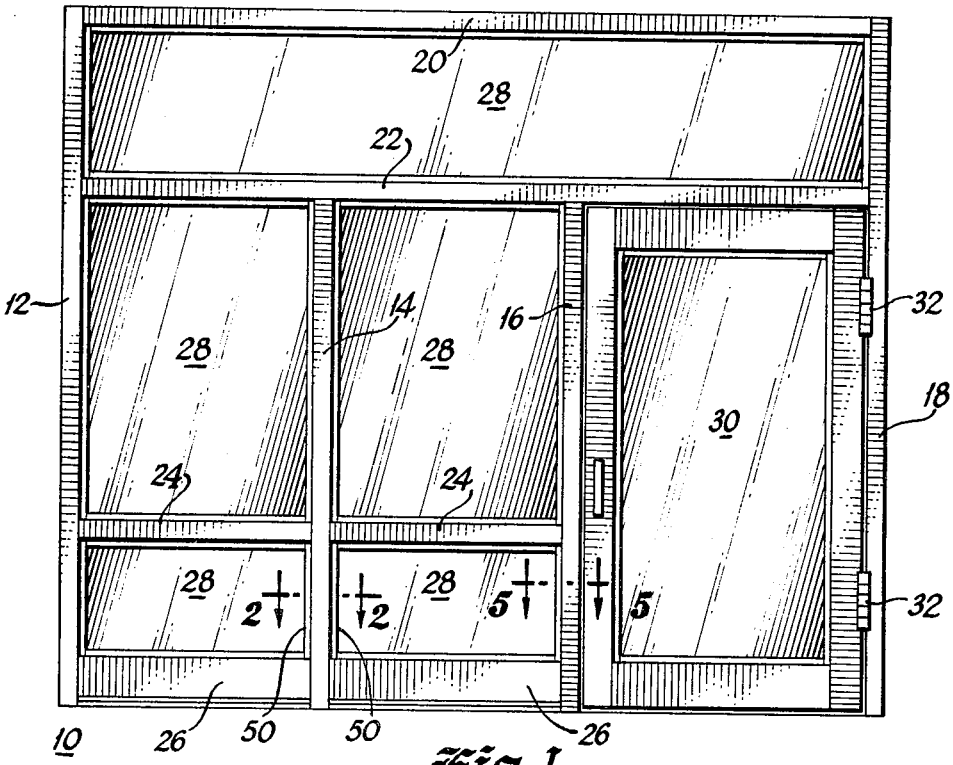
FIG. 1 is an elevational view of a curtain wall system converted in accordance with the present invention to provide improved heat insulating characteristics.

Referring now more particularly to the drawings, in FIG. 1 is illustrated an elevational view of a curtain wall structure 10 including a frame work including a plurality of vertical, spaced apart jambs and mullions 12, 14, 16 and 18. These vertical members are interconnected at appropriate levels with horizontally extending headers 20 and 22, intermediate horizontals 24 and lower sill members 26 to provide a plurality of rectangular, panel openings for accommodating a number of glazing panels 28 and/or a door 30 which is supported on the jamb 18 on a plurality of hinges 32.

The door 30 may be of a conventional, glass panel type such as that as shown in U.S. Pat. Nos. 3,798,863; 3,780,472 or 3,774,360, or preferably may be of an insulated type such as that shown in copending U.S. Patent Application Ser. No. 938,924, filed Sept. 1, 1978, which provides improved heat insulating characteristics.

The glazing panels 28 are preferably of the dual pane type employing inside and outside parallel glass panels **28*a* and 28*b*, respectively, which are separated from one another by a dead air space 28*c* and are sealed around their periphery by a suitable sealing and spacer assembly 28*d*. These unitary insulating type glazing panels are installed in accordance with the invention to improve the heat insulating characteristics of the curtain wall system 10** and replace the single thickness glazing panels (not shown) which are removed.

Referring more particularly to FIGS. 2, 3, 5 and 6, a typical, vertical structural element or mullion widely used for a number of existing buildings includes a hollow, tubular frame member 34 of a generally rectangular transverse cross-section. The frame member 34 has a pair of spaced apart parallel, opposite jamb faces **34*a* and 34*b*, respectively, with large and small glazing pocket 35 and 37, respectively, for receiving the edge portion of a single thickness glazing panel which is sandwiched between a pair of glazing wedges or gaskets 48** in a manner shown in U.S. Pat. Nos. 3,781,973; 3,782,062 or 3,961,452.

In accordance with the present invention, the existing single thickness glazing panels are first removed from the supporting frame work and the glazing wedges or gaskets associated therewith are detached from the pockets 35 and 37 in the mullions, jambs, sills, such as frame members 34. As described in the aforementioned patents, the glazing wedges or gaskets are keyed to the pocket walls and are seated within longitudinally extending grooves **35*a* and 35*b* on opposite sides of the large pocket and similar grooves 37*a* and 37*b* on opposite sides of the smaller pockets 37. When the glazing seals are removed, the existing single thickness glazing panels may then be removed and taken away and after this is completed the pockets in the structural frame members 34** are left clean and are ready for the conversion to an insulated system in accordance with the present invention as will be described hereinafter.

In order to accommodate the insulating glazing panels 28 which are considerably thicker than the single glazing panels that were removed and to form a new larger glazing pocket for the edges of the insulating panel thereof, there is provided an elongated, inside glazing stop element 40 preferably formed of metal such as extruded aluminum and having a generally, angle-shaped, transverse cross-section as illustrated in FIGS. 2 through 6. The inside stop elements are cut to an appropriate length at the job site to extend between pairs of intersecting cross-members and may be mittered at the corners, if desired, to fill the openings. The stop element 40 includes a relatively wide base or leg 42 which is adapted to seat against a jamb face **34*a* or 34*b* on an existing structural frame element 34 in covering relation over an open pocket 35 or 37. In order to properly align a stop element on the jamb face of a frame member, the base 42 is provided with a key-like guide rib 42*a* of angle-shaped transverse cross-section and the rib is adapted to seat in keyed interlocking relation within the glazing seal grooves 35*a* or 37*a* that are present in the pockets 35 and 37 of the frame member 34. This keyed interfitting engagement between the rib 42*a* of a new, glazing stop element 40 and the inside edge wall of a pocket in the tubular frame member provides for precise and proper alignment of the glazing strip or stop element longitudinally parallel along the jamb face 34*a* or 34*b*. The keyed, interfitting engagement between the rib 42*a* and the groove 35*a* in the pocket 35 of the mullion is effective to transmit the positive wind load forces acting on the panels 28 to the supporting mullion 34 through the stop element 40. The glazing stop elements are secured to the jamb faces by suitable fasteners such as sheet-metal, self tapping type headed screws 43 or other types of fasteners which can be rapidly installed to hold the leg 42** of a glazing stop element on the adjacent jamb face.

The glazing elements also include a shorter transverse leg and a stop flange 44 extending outwardly of the adjacent jamb face at right angles to the base or leg 42. The flanges 44 form an inside wall of a new and larger glazing pocket 45 which is adapted to accommodate the marginal edge portion of the dual thickness glazing panels 28 which replace the old single thickness glass panes. Adjacent the intersecting corner between the flange 44 and the leg 42 of the stop element 40, there is provided a groove 40*a* which opens toward the adjacent jamb face and seated within the elongated groove is sealing strip 46 of foam rubber or synthetic plastic material, which strip provides an inside seal between the attached glazing stop element 40 and the adjacent jamb face 34*a* or 34*b* of the existing frame member 34.

At the outer edge of the stop flange 44, an enlarged portion is provided with a groove 44*a* therein for supporting in keyed interlocking alignment, an elongated, glazing or seal wedge 48, preferably formed of rubber or plastic resilient material and adapted to provide a seal between the inside face of the inside glazing pane 28*a* of a new insulated glazing panel 28 and the stop element flange 44. The glazing wedges 48 may be those that were previously removed from sealing engagement with the single thickness glazing panels which were removed and the grooves 44*a* of the new glass stop elements 40 are preferably dimensioned and shaped in transverse cross-section to be identical or similar to the grooves 35*a*, 35*b*, 37*a* and 37*b* of the walls of the jamb pockets 35 and 37 of the members 34. Thus, the original glazing wedges 48 which were removed along with the existing single thickness glazing panels can be used in the new insulating panel installation if the glazing wedges are in good condition and are undamaged after removal. The inside glazing wedges 48 provide one internal weather seal acting against the inside surface of the dual thicknes insulating glazing panels 28 and another internal seal comprises the strip 46 so that excellent weather tight sealing is accomplished.

The outside wall of the enlarged glazing pocket 45 for the insulating, dual thickness glazing panels 28 is provided by an outside flange or stop element 50 having a generally channel-shaped, transverse cross-section including an outside face or wall 52 parallel of the glazing panel 28 and having an edge bearing against the adjacent jamb face of the structural support frame 34. The outside flange elements are formed with a transverse flange or wall 54 extending towards the outer surface of the glazing panels 28 at right angles to the outer face 52 and this flange is provided with a groove 54*a* on an enlarged free edge portion for seating and receiving an outside glazing wedge 48 which provides a first outside seal between the outside stop element 50 and the outer surface of a newly installed, dual thickness, glazing panel 28. The channel-shaped outside flange elements also include a second flange or wall portion 56 parallel of the jamb faces 34*a* or 34*b* and formed with a hook-shaped rib 56*a* along the free edge which is adapted to key and interlock with an oppositely configured, hook-shaped rib 42*b* formed along the free outer edge of the base portion 42 of the inside glazing stop element 40.

After the inside, metal stop element 40 is secured in place on the jamb surface 34*a* or 34*b* the outside channel-shaped flange element 50 is then secured in place on the jamb surface and interlocked with the inside element to form the new glazing pocket 45 for receiving the marginal edge portion of the dual thickness glazing panels 28. The glazing wedges 48 or other elongated sealing strips of suitable material seal between the respective inside and outside stop elements and the new glazing panels 28.

The channel-shaped outer flange element 50 is also provided with a recess for a second outer seal 46 formed of foam material which bears against the adjacent jamb surface 34*a* or 34*b* of the structural member 34. This second outer seal strip is secured in a pocket 50*a* provided by the wall or flanges 52 and 56 and a short rib 56*b* which extends toward the face of the adjacent jamb surface. Negative wind loads acting on the glazing panels 28 are transmitted to the mullion 34 via the outside stop element 50 interlocked through the ribs 42*b* and 56*a* to the leg 42 of the stop element 40 and the screw fasteners 43 distribute this load to the mullion face.

Figure 2:
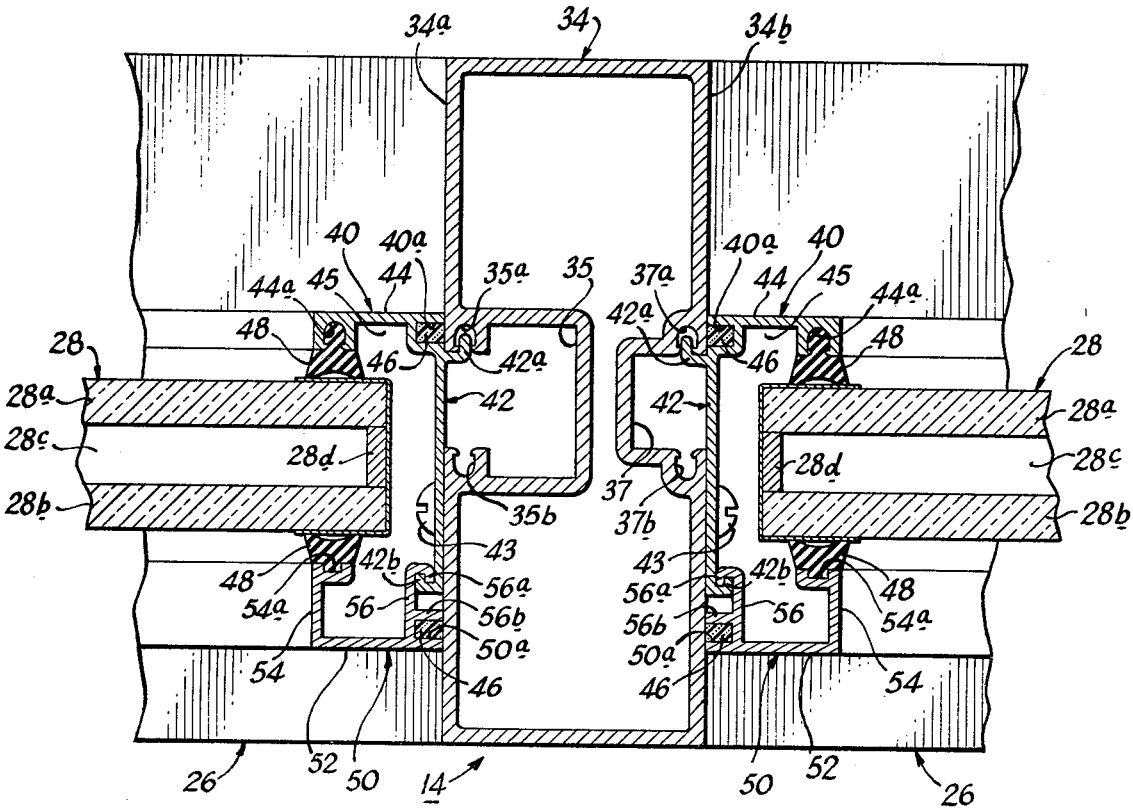
FIG. 2 is an enlarged, fragmentary, horizontal cross-sectional view taken substantially along lines 2—2 of FIG. 1.

As thus described and shown in FIG. 2, the completed insulated wall panel structure in accordance with the invention provides for a pair of outer sealing elements along with a pair of inner sealing elements, each pair comprising a glazing wedge 48 and a sponge type sealing strip 46. The replacement of the original single thickness glazing panels with the dual thickness glazing panels 28 provides a much better heat insulating characteristic for wall structures which employ large areas of glazing, and conversion in accordance with the system of the present invention is rapid and efficient and results in a neat and clean appearance with little change in an aesthetic standpoint from the appearance of the original, existing single glazed wall structure.

Figure 3:
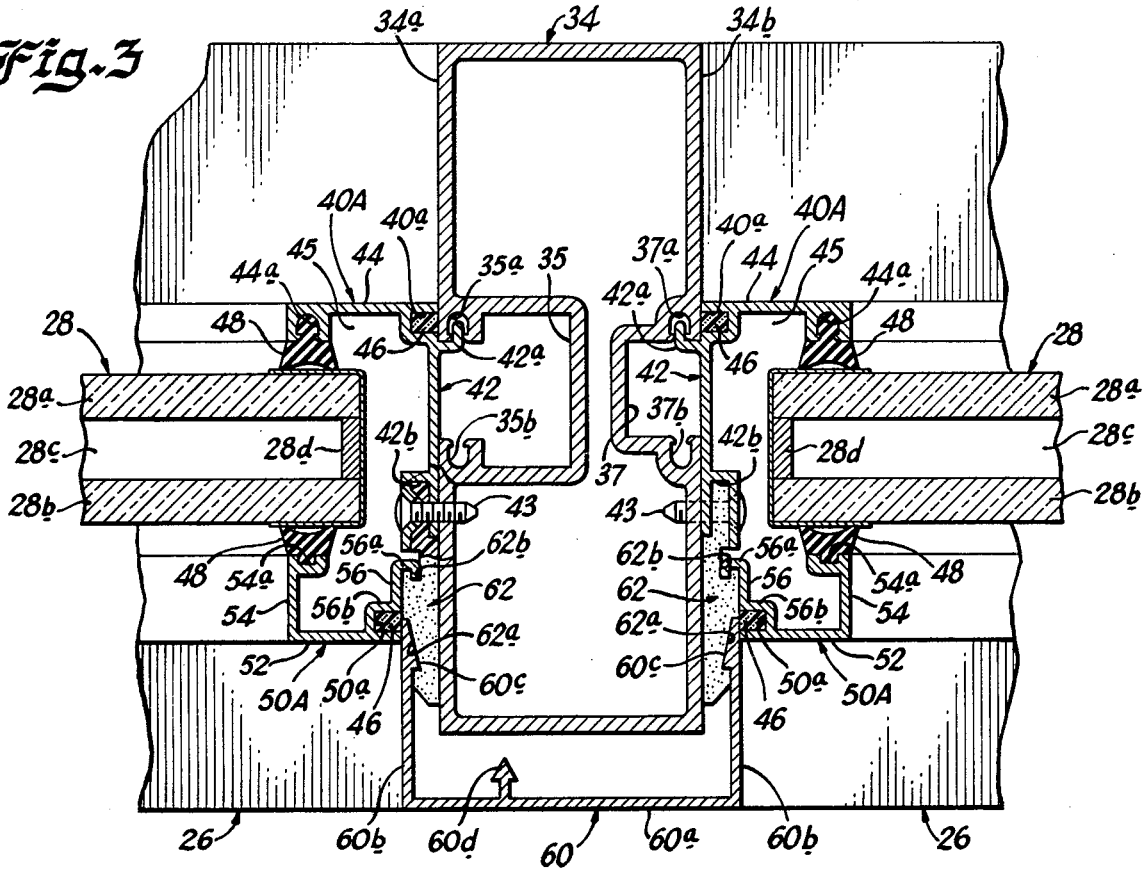
FIG. 3 is a cross-sectional view similar to FIG. 2 but illustrating another embodiment in accordance with the features of the present invention.

Referring now to FIG. 3, therein is illustrated another embodiment of the system of the present invention wherein it is desired to provide an even more improved heat insulating characteristic for the structural frame element or mullion 34 itself. In order to insulate the frame member or mullion along with replacing the glazing panels with insulating glass 28, the inside stop elements 40A and the outside flange elements 50A are of a type slightly different from the embodiment of FIG. 2 as will be described hereinafter, and a channel-shaped insulating cover element 60 is provided to overlap and insulate the outer wall portions of the mullions 34 to prevent high heat losses in these areas of the wall structure.

The insulating cover 60 includes an outer wall face 60*a* and a pair of inwardly directed jamb flanges 60*b*, each flange having an enlarged wedge shaped rib 60*c* along a free edge thereof adapted to snappingly engage within notches or grooves 62*a* which are formed in the outer surface of insulating clips 62 mounted adjacent the outer surface of the jambs 34*a* and 34*b* respectively. The insulating clips 62 are formed of heat insulating plastic material and are positioned at longitudinally spaced intervals along the outer edge portion of a channel-like recess 42*b* on the elongated inside stop element 40A.

Preferably, the insulating clips 62 are fixedly attached to the stop elements 40A at the factory at appropriate spacing intervals and the base or leg portions 42 of the stop element is formed with the relatively large channel-shaped recess along the outer free edge for receiving the inner ends of the plastic clips. The clips are secured in place on the stop element by means of the fasteners 43 which are inserted in a staking type operation. Installation of the inside stop elements 40A on the jamb surfaces 34*a* and 34*b* of a mullion also positions the pre-attached insulating clips 62 in place at appropriate longitudinal intervals. The channel-shaped, metal cover 60 is then snap fitted into place with the wedge ribs 60*c* along the edges of the side flanges 60*b* snapping into and interlocking in the grooves 62*a* provided in the insulating clips.

The clips are also provided with grooves 62b intermediate the grooves 62a and the fasteners 43, for interlocking and receiving angle-shaped ribs 56a provided on the inside flanges of the modified outside flange elements 50A. The distance or spacing between the inner ends of the clips 62 and the grooves 62b thereof provides means for gauging the desired distance between the inner and outer stop elements 40A and 50A so that inner and outer side walls of the new pocket are properly spaced apart to accommodate the new glazing panels 28. The outside flange elements 50A are designed to include a recess 50a for receiving a sponge-like, elongated, outside sealing strip 46 which bears against the outer surface of the adjacent cover element flange 60b to provide a second, outer seal in conjunction with another seal provided by the outer glazing wedge 48 which bears against the outside surface of the newly installed, dual thickness glazing panel 28.

Figure 4:
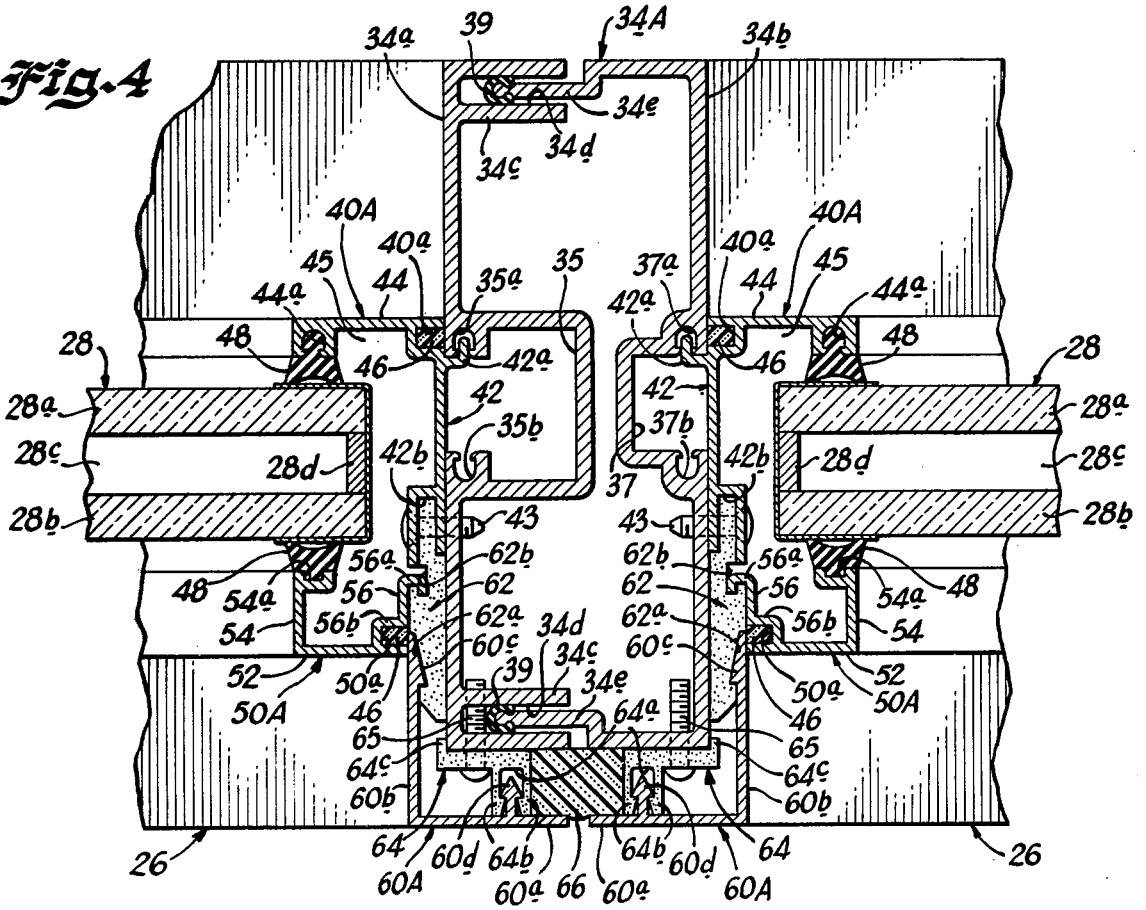
FIG. 4 is an enlarged, fragmentary, cross-sectional view similar to FIG. 2 showing yet another embodiment constructed in accordance with the features of the present invention.

Referring now more particularly to FIG. 4, another embodiment of the invention is adapted and designed to accommodate an expansion type mullion 34A having a pair of relatively movable mullion halves which provide the respective opposite jamb faces 34a and 34b. In this respect, as viewed in FIG. 4, the left hand mullion half includes a pair of internal ribs 34c parallel of the inner and outer mullion faces which form pockets 34d for slidably receiving stepped tongue portions 34e on the opposite (right hand) mullion half and this construction permits lateral relative movement between the mullion halves to accommodate expansion and contraction and construction tolerances when a number of glazing panels are arranged in a row. Each stepped tongue 34e is provided with a U-shaped, flexible sealing strip 39 attached on the outer end of the tongue to provide a sliding seal between the tongue and the adjacent side wall surfaces of the mullion pockets 34d in the female mullion half.

In order to accommodate the relative movement between the mullion halves yet still provide an efficient insulating cover for the metal structural elements instead of a unitary, channel-shaped, the outside cover is provided by a pair of separate cover members 60A, each of a generally angular shaped transverse cross-section. The outer faces 60a of the cover elements 60A are secured outwardly parallel of the respective outer faces of the mullion halves and each cover element is provided with an inwardly directed rib 60d having an arrow-shaped transverse cross-section. The ribs 60d are adapted to snappingly engage opposite side walls 64b of a recess 64a defined on a plurality of outer face, insulating clips 64 of plastic material. These clips are secured on the outer wall faces of the mullion halves at appropriate intervals by means of suitable fasteners 65, preferably of the self-tapping type. In order to insure that the recesses 64a of the outer insulating clips 64 are accurately aligned on the mullion faces, each clip is provided with a hooked end portion 64c which is adapted to bear against a jamb face 34a or 34b as the case may be and thus precisely position the recesses 64a of the clips ready for receiving the arrow-shaped tongues 60d of the respective insulating cover members 60A. An outer sealing strip 66 of sponge-like material is mounted between the outer faces of the halves of the expansion mullion 34A and the closely adjacent inside facing surfaces of the respective angle-shaped insulating cover elements 60A so that as the mullion halves move relative to one another, a continuous seal is provided and maintenance between the cover elements 60A and the outer faces of the mullion halves. It will thus be seen from the embodiment of FIG. 4, that the heat insulating characteristics of an expansion type mullion 34A having relatively movable mullion halves is greatly improved with the insulating system of the present invention employing a pair of relatively movable outer cover elements 60A described.

Figure 5:
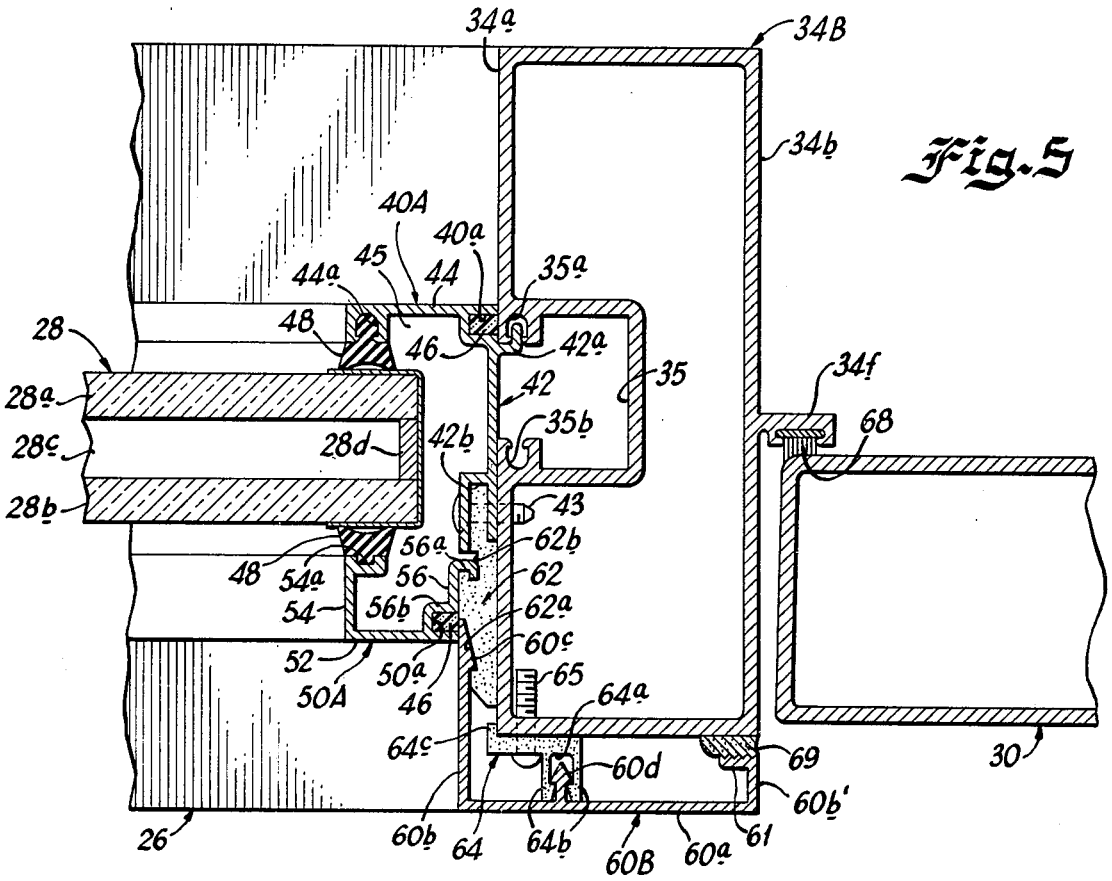
FIG. 5 is an enlarged, fragmentary, cross-sectional view taken substantially along lines 5—5 of FIG. 1.

Referring now to the embodiment of FIG. 5, a mullion 34B is of a type designed to serve as a door jamb for a door 30 and for this purpose the mullion face 34b is provided with a door stop 34f having a groove therein for receiving elongated weather strip 68. An outer cover element 60B of modified form is provided and is generally similar to the cover element 60 except for the fact that one flange 60b' is shortened relative to the opposite flange and is provided with an outer face in co-planar alignment with the mullion face 34b as illustrated. The short flange 60b' is provided with an inturned rib portion 61 having a serrated surface for good adhesion with a strip of caulking material 69 which is gunned in place to provide a good seal between the cover element 60B and the outside jamb face 34b of the door jamb 34B.

Figure 6:
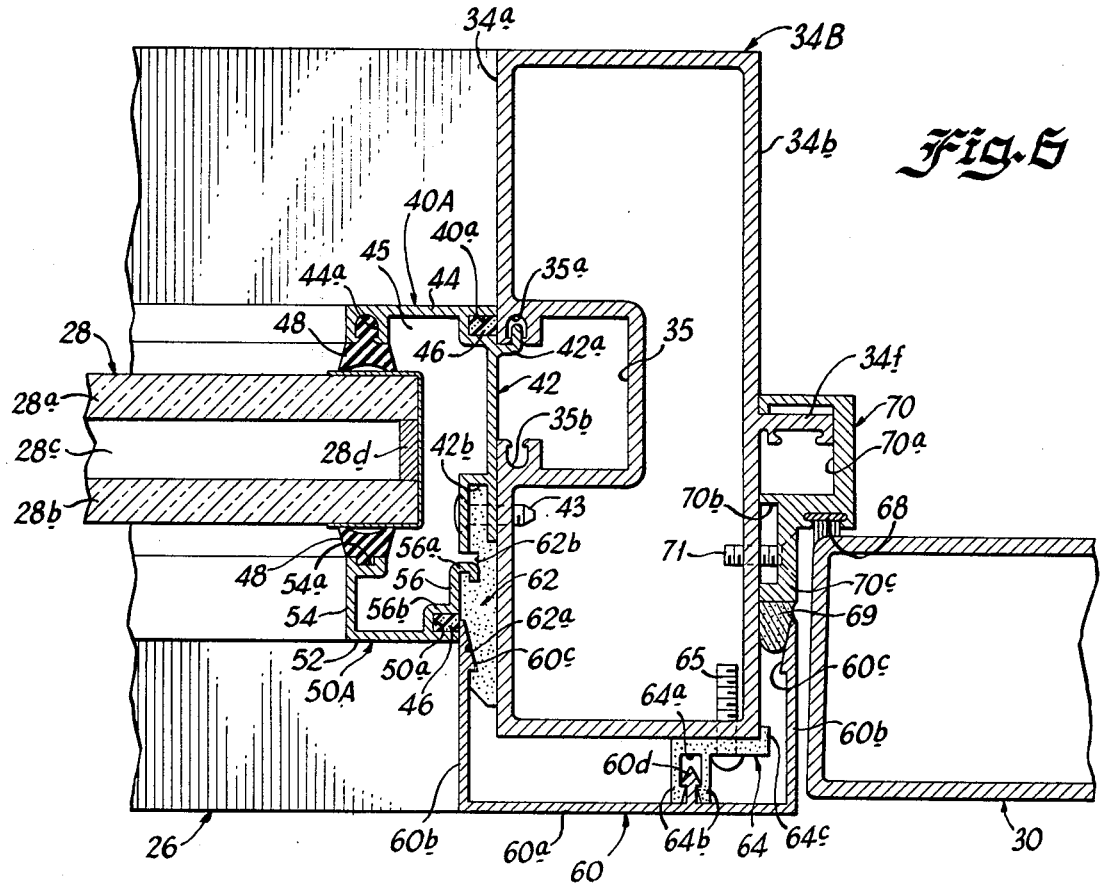
FIG. 6 is an enlarged, fragmentary, cross-sectional view similar to FIG. 5 illustrating yet another embodiment of the present invention.

FIG. 6 illustrates yet another embodiment of a door jamb mullion configuration wherein the integral door stop 34f of the mullion 34B is enclosed within a separate metal door stop 70 having an inside pocket 70a for enclosing the stop 34f and a smaller outside pocket 70b having an outer face 70c aligned with the outside face of the right hand flange 60b of a channel-shaped insulating cover element 60. A strip of caulking material 69 is provided between the outside edge of the separate door stop 70 and the adjacent rib 60c along the edge of the cover flange. Insulating clips 64 of the type previously described are secured adjacent the right hand corner of the outer face of the door jamb mullion 34B in order to receive the arrow-shaped tongue 60d of the cover element to secure the element in place. As indicated in FIG. 6, the cover is first secured by pairs of plastic clips 62 and 64 mounted on a respective jamb face 34a and the outer mullion face at right angles therewith. The enlarged, right hand wedge rib 60c of the cover element is not secured in placed with an additional clip and is sealed with the new top 70 by means of caulking material 69.

From the foregoing it will be seen that the present invention provides a new and unique system for improving the heat insulating characteristics of existing wall structures of the type employing relatively large areas of glass that is supported in metal frames. The system provides for the installation of new dual thickness, glazing panels or other types of insulating panels having greatly improved heat insulating characteristics in comparison to the original single thickness type glazing panels as originally installed. In addition, the system provides a means for insulating the metal frame members which support the panels and is adapted for use with both conventional and expansion type mullions, as well as with mullions which serve as door jambs.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A system for the conversion of an existing wall structure into an insulated panel wall structure, said existing wall structure including a panel to be removed and a panel edge supporting frame having a pocket in a jamb face; said system comprising:

an elongated stop element having a base adapted to be secured to said jamb face extending into said pocket after removal of said existing panel therefrom;

said stop element including a first flange extending outwardly of said jamb face forming one side wall of a new pocket for receiving an edge portion of an insulating panel and a second flange extending along said jamb face closing over said pocket forming a bottom wall of said new pocket; and an elongated flange element adapted to be secured on said second flange in spaced parallel alignment with said first flange of said stop element forming an opposite side wall of said new pocket for said insulating panel.

2. The system of claim 1 wherein said stop element includes key means extending into said jamb pocket for aligning said stop element in position on said frame.

3. The system of claim 2 wherein said key means includes tongue means for keyed interlocking engagement with a recess in a side wall of said jamb pocket.

4. The system of claim 2 wherein said key means includes a surface engaging said frame for transmitting windloads acting on said insulating panel in one direction to said frame.

5. The system of claim 4 including fastener means securing said stop element on said frame remote from said key means for transmitting wind loads acting on said insulating panel in an opposite direction to said frame.

6. The system of claim 1 wherein said flange element and said stop element include key means providing interlocking keyed engagement therebetween for positioning said flange element to form said opposite side wall of said new pocket in parallel with said first flange.

7. The system of claim 6 wherein said interlocking means includes clip means secured to said stop element.

8. The system of claim 5 including a cover element secured to said clip means spaced outwardly of said frame.

9. The system of claim 8 including an elongated seal between said cover element and said flange element.

10. The system of claim 9 including an elongated seal between said flange element and said insulated panel.

11. The system of claim 9 or 10 including an elongated seal between said stop element and said insulated panel.

12. The system of claim 8 wherein said cover element includes a deflectable portion adapted to snap into locking engagement with said clip means.

13. The system of claim 8 wherein said cover element includes a portion providing a new jamb surface spaced outwardly of said jamb face of said frame.

14. The system of claim 13 wherein said clip means provides a heat insulating spaced relation between said cover element and said jamb face of said frame.

15. The system of claim 8 including a second clip mountable on said frame spaced from said clip means for supporting said cover element remote from said clip means.

16. The system of claim 15 wherein said second clip and said clip means are formed of heat insulating material supporting said cover element spaced apart from said frame in heat insulated relation thereto.

17. The system of claim 15 wherein said second clip includes positioning means for locating the same on said frame in selected spaced relation to said clip means.

18. The system of claim 15 wherein at least one of said clip means and second clip includes means for retaining said cover element in position on said frame.

19. The system of claim 18 wherein said cover element is deflectable for movement into and out of engagement with said retaining means.

20. The system of claim 15 wherein said frame includes a second jamb surface supporting said second clip in spaced apart relation to said clip means.

21. The system of claim 20 wherein said cover element is mounted to span between said second clip and said clip means is outwardly spaced to said frame.

22. The system of claim 20 wherein said second jamb surface is generally normal to said jamb face.

23. The system of claim 20 wherein said second jamb surface is in spaced apart parallel relation with said jamb face.

24. The system of claim 20 wherein said jamb face and said second jamb surface intersect to form a corner on said frame and said cover element is in spaced covering relation around said corner.

25. The system of claim 20 including an elongated seal between said cover element and said second jamb surface.

26. The system of claim 15 wherein said clip means comprises a plurality of heat insulating clips spaced apart on said frame longitudinally thereof including a plurality of heat insulating second clips spaced apart on said frame longitudinally thereof.

27. The system of claim 6 wherein said interlocking means includes clip means formed of heat insulating material secured on said frame.

28. The system of claim 6 or 7 wherein said interlocking means includes elongated tongue and groove connectors formed on said flange and said stop element.

29. The system of claim 6 or 7 wherein said interlocking means includes means for spacing said side walls of said new pocket a selected distance apart.

30. The system of claim 29 wherein said last mentioned means includes clip means with a gauging element for providing said selected spacing between said side walls when said elements are secured in place on said frame.

31. The system of claim 1 including an elongated seal between said elongated stop element and said jamb face.

32. The system of claim 31 wherein said stop element includes an elongated groove facing said jamb face and said seal is mounted in said groove.

33. The system of claim 31 or 32 including an elongated seal between a face of said insulated panel and said flange of said stop element.

34. The system of claim 1 including an elongated seal between said elongated flange element and said jamb face.

35. The system of claim 34 wherein said flange element includes an elongated groove facing said jamb face and said seal is mounted in said groove.

36. The system of claim 34 or 35 including an elongated seal between a face of said insulated panel and said flange element.

37. The system of claim 1 or 31 including an elongated seal between said stop element and a face of said insulated panel.

38. The system of claim 37 including an elongated seal between said flange element and a face of said insulated panel.

39. The system of claim 1 or 34 including an elongated seal between said flange element and a face of said insulated panel.

40. The system of claim 39 including an elongated seal between said stop element and a face of said insulated panel.

* * * * *